United States Patent [19]

Pawski

[11] Patent Number: 4,878,329

[45] Date of Patent: Nov. 7, 1989

[54] STRUCTURAL PANELS FOR WALLS, FLOORS AND ROOFS HAVING EXTERIOR METAL LAYERS AND AN INSULATING CONCRETE CORE

[75] Inventor: Rolf P. Pawski, Glen Ellyn, Ill.

[73] Assignee: CBI Research Corporation, Plainfield, Ill.

[21] Appl. No.: 219,481

[22] Filed: Jul. 15, 1988

[51] Int. Cl.[4] ..... E04B 1/32

[52] U.S. Cl. ..... 52/245; 52/249; 52/282; 52/601; 52/761

[58] Field of Search ..... 52/281, 282, 245, 761, 52/82, 247, 774, 781, 821, 601, 596; 220/5 A, 1 B

[56] References Cited

U.S. PATENT DOCUMENTS

| | | | |
|---|---|---|---|
| 859,295 | 7/1907 | Hill . | |
| 876,299 | 1/1908 | Conley | 52/761 X |
| 1,093,077 | 5/1914 | Annison . | |
| 1,806,354 | 5/1931 | Lange | 52/282 X |
| 1,841,759 | 1/1932 | Nolte . | |
| 2,607,411 | 8/1952 | Van Vliet . | |
| 2,978,020 | 4/1961 | Paulsrude . | |
| 3,297,077 | 1/1967 | Garbus . | |
| 3,324,930 | 6/1967 | Colombo . | |
| 3,448,554 | 6/1969 | Apesteguy | 52/281 X |
| 3,603,052 | 9/1971 | Novoa | 52/281 X |
| 3,826,056 | 7/1974 | Smith et al. | 52/761 X |
| 3,889,736 | 6/1975 | Firks . | |
| 4,060,945 | 12/1977 | Wilson | 52/245 X |
| 4,438,605 | 3/1984 | DeLucia . | |

FOREIGN PATENT DOCUMENTS 2153202 5/1973 Fed. Rep. of Germany ..... 52/245

OTHER PUBLICATIONS

S. K. Solomon et al. "Flexural Tests of Steel-Concrete-Steel Sandwiches", Magazine of Concrete Research, Mar., 1976, pp. 13 to 20.

G. M. Parton et al., "Polystyrene Concrete Sandwich Beams: Stiffness and Ultimate Load Analysis", The International Journal of Cement Compositions and Lightweight Concrete, vol. 4, No. 4, Nov. 1982.

Concrete International, Dec., 1983, article entitled "Concrete Sandwich Research Underway".

*Primary Examiner*—David A. Scherbel
*Assistant Examiner*—Lan Mai
*Attorney, Agent, or Firm*—Marshall, O'Toole, Gerstein, Murray & Bicknell

[57] ABSTRACT

A structure for use as a wall, floor or roof comprising a plurality of panels with a pair of spaced apart elongated edges; each panel having front and back metal layers of substantially the same shape joined to an insulating concrete core of substantially uniform thickness; the panels being arranged edge-to-edge with an elongated metal member between the edges of two adjacent panels; and the edges of the panels being joined to the adjoining elongated metal member.

27 Claims, 3 Drawing Sheets

STRUCTURAL PANELS FOR WALLS, FLOORS AND ROOFS HAVING EXTERIOR METAL LAYERS AND AN INSULATING CONCRETE CORE

This invention relates to structural panels for walls, roofs and floors of storage tanks and buildings. More particularly, this invention provides a novel panel having a concrete core covered front and back with metal layers and a plurality of which are readily assembled into a storage tank or a building wall, floor or roof.

BACKGROUND OF THE INVENTION

The construction of buildings, storage tanks and other structures often requires much fabrication and labor at sites which are remote from suppliers, service facilities and manufacturing plants. Additionally, environmental conditions are often harsh at the construction sites due to cold weather, storms or excessive heat. For these and other reasons, such as the comfort and convenience of the workers as well as quality control and increased productivity, it is generally desirable to do as much in shop fabrication and assembly as can be practically done.

When a building, storage tank or other structure is to be built, it is recognized that various components can be produced in the shop and then be transported to the site for assembly. In the case of walls, floors and roofs, various types of panels or modules have been shop produced and later assembled at the site. However, because the size of the structures has increased in recent years, as well as the loads which they must carry, a need has developed for larger and stronger panels which can be shop-made in different sizes and also be readily assembled in the field into strong useful structures of the same or different shapes.

SUMMARY OF THE INVENTION

According to the invention a novel panel is provided comprising front and back metal layers of substantially the same shape, joined to an insulating concrete core of substantially uniform thickness, with each metal layer having a pair of spaced apart elongated edges; an elongated metal member adjoining a pair of metal layer edges; and means joining the pair of metal layer edges to the adjoining elongated metal member.

The elongated metal member can be joined to the concrete by an adhesive. Also, the metal layers can be bonded to the concrete by an adhesive.

The elongated metal member can be of any suitable shape and specifically it can be a tube circular in lateral section. The edge of the concrete adjoining the elongated metal member can be a concave trough in which the metal member nests.

In a further embodiment of the invention the edge of the concrete adjacent the metal member can be a concave trough covered by a metal liner joined to the front and back metal layers with the metal member nesting in the liner. The other edge of the pair of panel edges can have a concave trough in which the metal member of an identical adjacent panel can nest.

The metal layers provide the primary structural strength of the panel and act as a weather shield to maintain a constant environment for the concrete core. This is especially desirable because concrete, especially low density concrete used for insulating purposes, quickly loses its insulating value when wet.

The elongated metal member serves to protect at least one, and generally both, of the concrete edges. It also functions as a type of articulated joint by permitting adjoining panels to be connected together at varying angles. It also increases the strength of the panel by preventing relative movement between the front and back metal layers and by confining the concrete core.

According to a further aspect of the invention a structure is provided for use as a wall, floor or roof comprising a plurality of panels with a pair of spaced apart elongated edges; each panel having front and back metal layers of substantially the same shape joined to an insulating concrete core of substantially uniform thickness; the panels being arranged edge-to-edge with an elongated metal member between the edges of two adjacent panels; and means joining the edges of the panels to the adjoining elongated metal member.

The metal layers can be welded to the elongated metal members to form liquid tight joints.

All the panels can have substantially the same size and shape. However, the pair of spaced apart elongated edges can be parallel to each other as in a rectangular panel or the edges can converge and form arrow point shaped panels. The elongated edges of all panels are desirably straight. The panels can be substantially planar or curved in one or both directions.

The concrete portion of one or both edges of each panel can be bonded to the adjoining elongated metal member by an adhesive.

The elongated metal member is desirably straight and is desirably a straight metal tube circular in lateral section. Such tubes substantially reinforce the structure.

A specific structure according to the invention is an enclosed storage tank comprising a bottom, a vertical space-surrounding wall supported by the bottom and a roof supported by the wall; the wall comprising vertical panels with parallel vertical edges; each panel having front and back metal layers joined to an insulating concrete core of substantially uniform thickness; the panels being arranged edge-to-edge, desirably in a ring-like formation, with means joining the adjacent vertical edges of the panels together. Specifically, a vertical metal column can be located between the vertical edges of two adjacent panels and the front and back metal layers of the panels can be welded to the column. The columns constitute one for of the elongated metal members referred to above.

All the panels used in the tank wall desirably have substantially the same size and shape. When the panels are substantially planar the tank wall forms a polygon. When the panels are arced or curved to a segment of a circle the wall is essentially circular. The column tube diameter is desirably greater than the thickness of the panels to facilitate joining a second panel to the column of a first panel at different or variable angles during assembly of the tank wall.

BRIEF DESCRIPTION OF THE DRAWINGS

To the extent it is reasonable and practical, the same or similar parts or elements which appear in the various views of the drawings will be identified by the same numbers.

Figure 1:
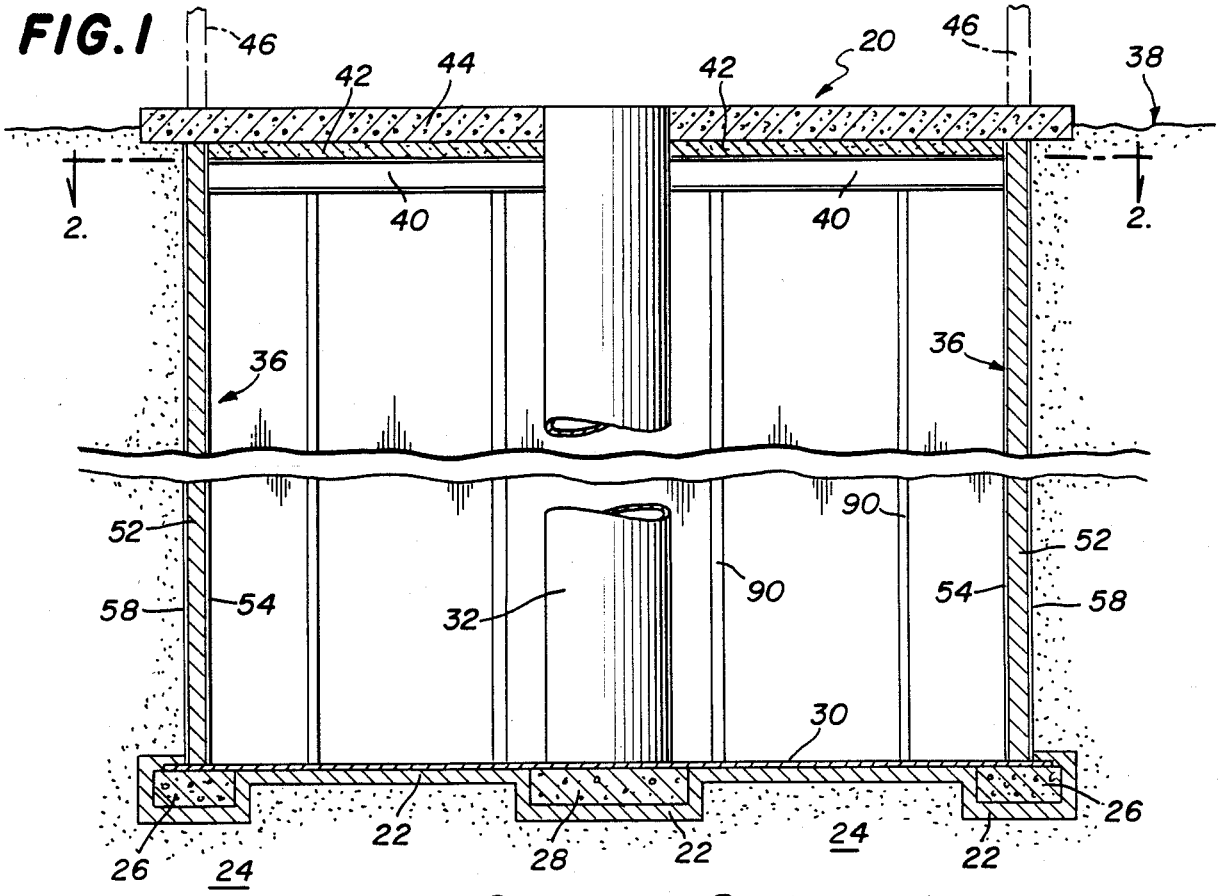
FIG. 1 is a vertical sectional view of a storage tank, according to the invention, located below ground level.
Figure 2:
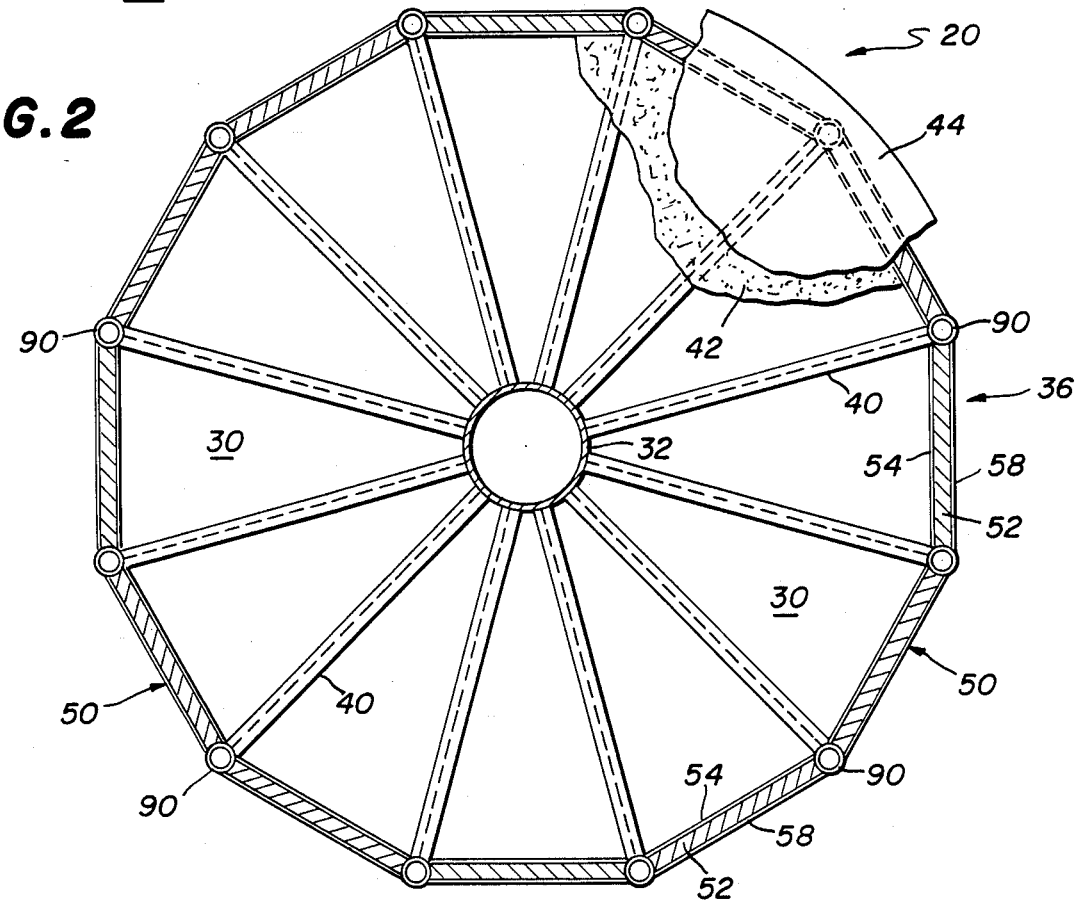
FIG. 2 is a sectional view taken along the line 2—2 of FIG. 1

With reference to FIGS. 1 and 2, the storage tank 20, located below ground level and which can be used to store an ice-aqueous ethylene glycol mixture for cooling purposes, has a layer of load bearing insulation such as high density foamed 1 lystyrene 22 positioned on the ground support 24. A foundation ring of conventional or lightweight insulating concrete 26 is positioned on the insulation 22. Additionally, a circular foundation slab of conventional or lightweight insulating concrete 28 is centrally positioned within ring 26.

Flat metal bottom sheet 30 is located on the top of ring 26, slab 28 and insulation 22. Centrally located metal tubular column 32, which can be used as a pump well, can be supported at the bottom on sheet 30 to which the column can be welded or otherwise secured. It is not necessary, however, for sheet 30 to extend under column 32. Sheet 30 could terminate at the edge of column 32 and be welded thereto.

Vertical wall 36 is supported by, and extends upwardly from, the edge of bottom sheet 30 to approximately ground level 38. Metal framing members or beams 40 extend horizontally from column 32 to column 90. A layer of optional insulation 42 is supported on the top of beams 40. Additionally, a roof of concrete 44 covers the entire area surrounded by wall 36. The roof 44 is supported both by the top of wall 36 and beams 40. If desired, mechanical building walls 46 can be supported on concrete roof 44.

Figure 3:
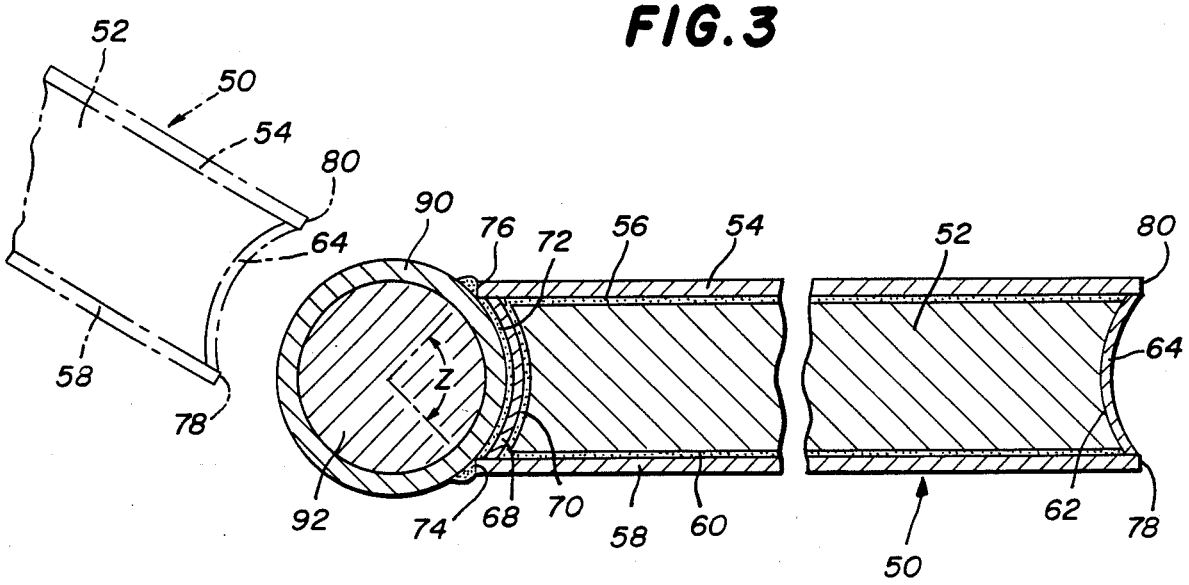
FIG. 3 is a sectional view of a panel used to fabricate the tank shown in FIGS. 1 and 2.

The tank wall 36 is fabricated from a plurality of identical panels 50 (FIG. 3). Each panel 50 has a concrete core 52 of essentially uniform thickness and rectangular shape. Front rectangular flat metal layer 54 is joined to one side of concrete core 52 by a suitable adhesive 56, such as an epoxy-type adhesive. Similarly, back rectangular flat metal layer 58 is joined to the other side of concrete core 52 by adhesive 60, which can also be a epoxy-type adhesive.

One concrete edge 62 of the concrete core 52 is covered by layer or edging 64. Edging 64 is in the shape of a trough having a lateral concave sectional shape which matches the surface of elongated tubular member or column 90. Edging or liner 64 can be welded to front and back metal layers 54, 58. The other concrete edge 66 of core 52 is covered by an edging or liner 68 which can be secured in place by an adhesive 70, such as an epoxy adhesive. The edging or liner 68 is in the shape of a trough having a lateral concave sectional shape which matches the column 90. Column 90 is bonded to edging or liner 68 by adhesive 72. The adjoining edges 74, 76 of metal layers 54, 58 are welded to column 90 to produce a liquid tight joint. If desired, an adhesive 72 can be optionally used to bond the column 90 to edging or liner 68 although in this embodiment it is not considered essential.

The described panel 50 has an overall thickness between the outermost surfaces of metal layers 54, 58 which is less than the outer diameter of column 90. As shown in FIG. 3, the angle Z from the center of column 90 to the edges 74, 76 should generally not be greater than 120° although the angle will usually not be less than 60°. By using a column which is thicker than the panel between layers 54, 58, the edge 64 of a second identical panel 50 (FIG. 3) can be nested at a variable angle to column 90 until the adjoining edges of front layers 54, or back layers 58, of two different panels abut on the column surface. If the edges 74, 76 were located at the diameter of column 90, two panels could only be joined together in a straight line.

To form a polygonal shaped wall 36 from panels 50, the edging or liner 64 of one panel is placed in abutting nesting position with a column 90 of an identical adjoining panel. An adhesive can be used to bond edging or liner 64 to column 90. Additionally, the adjoining edges 78, 80 of layers 58, 54 are welded to column 90 to produce a leak tight joint. This procedure is repeated using as many panels 50 as needed to produce tank wall 36. The wall can then be welded at the bottom front and back edges to tank bottom 30 to produce a liquid tight joint. If desired, each column 90 can be filled with insulating concrete or loose fill insulation 92.

The tank wall 36 produced from panels 50 is characterized by large bending stiffness, which is a necessity to prevent bucking of the tank due to earth pressure loads. Additionally, the core 52, when made of lightweight insulating concrete, permits use of the tank for storing a product at a temperature above or below the surrounding ambient temperature with minimal heat transfer through the wall.

Not only do the columns 90 serve to join the panels together but they also function as structural members which greatly strengthen the completed wall.

Figure 4:
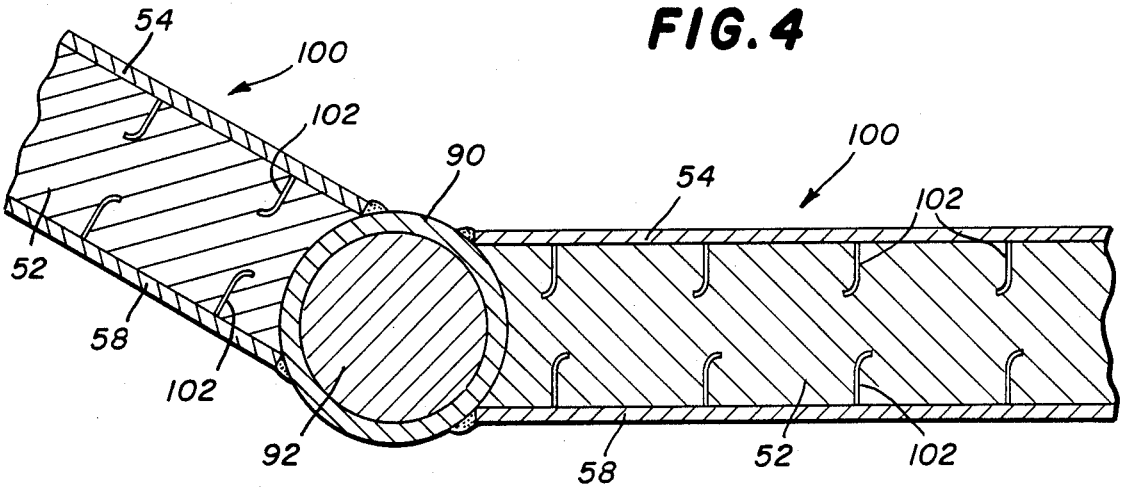
FIG. 4 is a sectional view of a wall using a second embodiment of panel which can be used for the wall of the tank shown in FIGS. 1 and 2.

FIG. 4 illustrates a second panel embodiment. In this embodiment, the panel 100 has the front and back metal layers, 54, 58 joined to concrete core 52 by metal rods 102 which extend into the concrete core from the metal layers 54, 58 to which they are attached by welding. Concrete core 52 can be cast into place after the layers 54, 58 are properly positioned. After the core hardens, the column 90 can be connected to the edges of a pair of layers 54, 58 by welding to complete a panel. Such a panel can be shop fabricated and then field assembled to produce a tank wall, roof or floor. Each such panel will have a column 90 along one longitudinal edge, but generally not along the other edge, of layers 54, 58.

Figure 5:
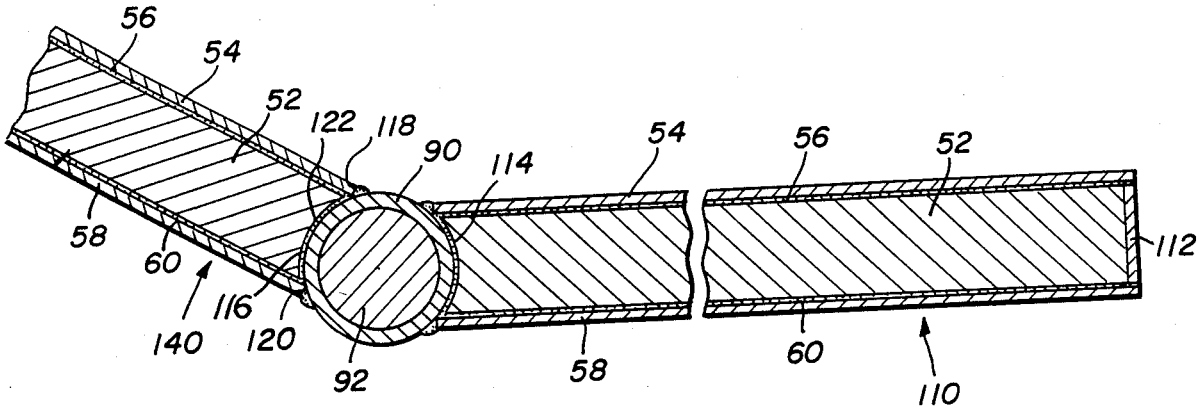
FIG. 5 is a sectional view of a wall portion using one panel having a squared-off closed end.

FIG. 5 shows a further panel embodiment. The panel 110 has a squared-off elongated edge covered by a metal edging 112 in direct contact with concrete core 52. Such a panel edge is appropriate when the structural continuity provided by column 90 is not required. The edging 112 can be primarily a weather seal, and need not necessarily provide confinement of the core 52 as does column 90.

Figure 7:
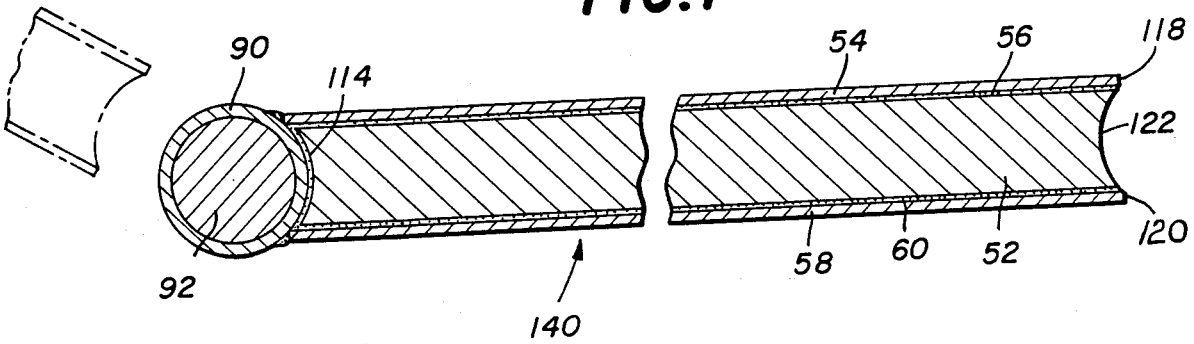
FIG. 7 is a similar to FIG. 3 but shows a wall portion made of panels with the concrete edges devoid of a trough liner or panel edging.

The panel 110 is shown in FIG. 5 joined to a panel 140 illustrated in FIG. 7. The exposed concrete edge 122 of panel 140 is bonded directly to column 90 by an adhesive 116 and then the edges 118, 120 of metal layers 54, 58 are joined to the column by welding.

Figure 6:
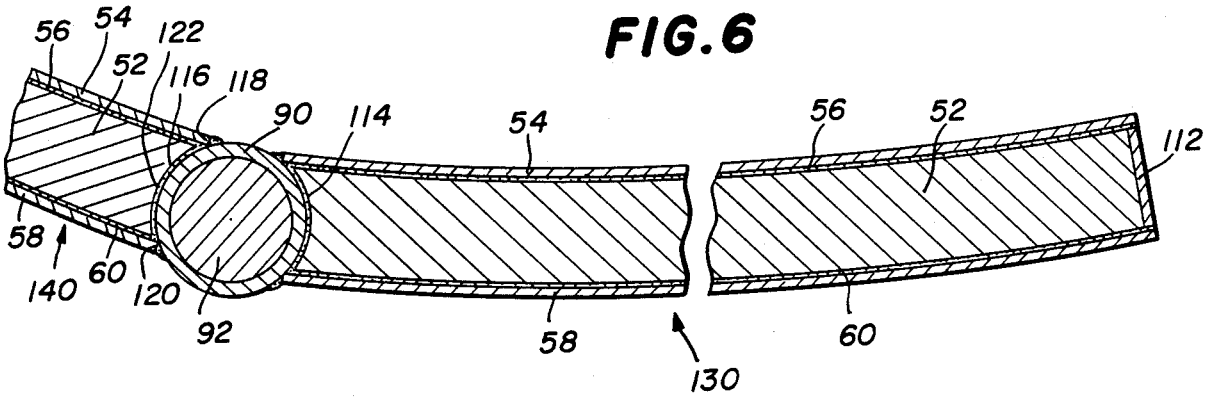
FIG. 6 is sectional view, similar to FIG. 5, but using curve.

FIG. 6 illustrates a panel 130 which is similar to panel 110 except that in panel 130 the concrete core 52 and metal layers 54, 58 are arced and constitute segments of a circle and thus can be used to produce a circular wall or even a roof. FIG. 6 also shows the edge of a panel 140 (FIG. 7) joined to column 90 as described in conjunction with FIG. 5.

The panel 140 shown in FIG. 7 is like panel 110 of FIG. 5 except that instead of a metal edging or liner 112, panel 140 has an exposed concrete edge 122 in the form of a curved trough which can nest with a column 90 of an adjoining panel.

The foregoing detailed description has been given for clearness of understanding only, and no unnecessary limitations should be understood therefrom, as modifications will be obvious to those skilled in the art.

What is claimed is:

1. A structure for use as a wall, floor or roof comprising:

a plurality of panel with a pair of spaced apart elongated edges;

each panel having front and back metal layers of substantially the same shape joined to an insulating concrete core of saubstantially uniform thickness;

the panels being arranged edge-to-edge and separated by adjoining elongated metal members provided between the edges of adjacent panels;

the front and back metal layers of each panel having adjoining edges; and means joining the adjoining edges of the front and back metal layers to the adjoining elongated metal member.

2. A structure according to claim 1 in which the adjoining edges of the front and back metal layers are welded to the elongated metal members to form liquid tight joints.

3. A structure according to claim 1 in which all the panels have substantially the same size and shape.

4. A structure according to claim 1 in which each elongated metal member is a circular metal tube.

5. A structure according to claim 1 in which the concrete portion of at least one edge of each panel is bonded to the adjoining elongated metal member by an adhesive.

6. A structure according to claim 1 in which the concrete portion of each edge of the pair of edges of each panel is bonded to the adjoining elongated metal member by an adhesive.

7. A structure according to claim 1 in which the panels are substantially planar.

8. A structure according to claim 1 in which each panel is curved in one direction.

9. An enclosed storage tank comprising:

a bottom, vertical space-surrounding wall supported by the bottom and a roof supported by the wall;

the wall comprising vertical panels with parallel vertical edges;

each panel having front and back metal layers joined to an insulating concrete core of substantially uniform thickness;

the panels being arranged edge-to-edge; and means joining the adjacent vertical edges of the panels together.

10. An enclosed storage tank according to claim 9 in which:

a vertical metal column is located between the adjacent vertical edges of the panels;

the front and back metal layers of each panel having adjoining edges; and the adjoining edges of the front and back metal layers are joined to the column.

11. An enclosed storage tank according to claim 10 in which the front and back metal layers have vertical edges joined to the adjacent vertical column.

12. An enclosed storage tank according to claim 9 in which the edges of the panels are welded to the columns to form liquid tight joints.

13. An enclosed storage tank according to claim 9 in which all the panels have substantially the same size and shape.

14. An enclosed storage tank according to claim 10 in which each column is a circular metal tube filled with insulating material.

15. An enclosed storage tank according to claim 10 in which the concrete portion of at least one vertical edge of each panel is bonded to the adjoining column by an adhesive.

16. An enclosed storage tank according to claim 10 in which the concrete portion of each vertical edge of each panel is bonded to the adjoining column by an adhesive.

17. An enclosed storage tank according to claim 9 in which the panels are substantially planar and the tank wall forms a polygon.

18. An enclosed storage tank according to claim 9 in which the wall is essentially circular.

19. An enclosed storage tank according to claim 14 in which the column tube diameter is greater than the thickness of the panels.

20. A panel comprising:

front and back metal layers of substantially the same shape, joined to an insulating concrete core of substantially uniform thickness, and with each metal layer having a pair of spaced apart elongated edges;

an elongated metal member which comprises a tube circular in lateral section, adjoining a pair of metal layer edges; and means joining the pair of metal layer edges to the adjoining elongated metal member.

21. A panel according to claim 20 in which the elongated metal member is joined to the concrete by an adhesive.

22. A panel according to claim 20 in which the metal layers are bonded to the concrete by an adhesive.

23. A panel according to claim 20 in which the edge of the concrete adjoining the tube is a concave trough in which the tube nests.

24. A panel according to claim 23 in which the tube is joined to the concrete by an adhesive.

25. A panel according to claim 20 in which the edge of the concrete adjacent the tube is a concave trough covered by a metal liner joined to the front and back metal layers and the tube nests in the liner.

26. A panel according to claim 21 in which the diameter of the tube is greater than the thickness of the panel.

27. A panel according to claim 21 in which the panel has an edge, opposite the elongated metal tube, in which the tube of an identical panel can nest.

* * * * *

UNITED STATES PATENT AND TRADEMARK OFFICE

CERTIFICATE OF CORRECTION

PATENT NO. : 4,878,329

DATED : November 7, 1989

INVENTOR(S) : ROLF P. PAWSKI

It is certified that error appears in the above-identified patent and that said Letters Patent is hereby corrected as shown below:

Column 2, line 47, change "for" to -- form --; column 3, line 4 , change "curve and" to -- curved panels; and --; line 5, delete "a" first occurence; line 18, delete "1 lystyrene" and in place thereof insert -- polystyrene --; column 4, line 29, change "bucking" to -- buckling --; column 5, line 15, change "panel" to -- panels --; claim 24, line 1, change "23" to -- 20 --; claims 26 and 27, line 1, change "21" to -- 20 --.

Signed and Sealed this

Twenty-third Day of October, 1990

*Attest:*

HARRY F. MANBECK, JR.

*Attesting Officer*

*Commissioner of Patents and Trademarks*